US011549747B2

(12) United States Patent
Hirose et al.

(10) Patent No.: US 11,549,747 B2
(45) Date of Patent: Jan. 10, 2023

(54) CRYOGENIC AIR SEPARATION APPARATUS

(71) Applicant: L'Air Liquide, Societe Anonyme pour l'Etude et l'Exploitation des Procedes Georges Claude, Paris (FR)

(72) Inventors: Kenji Hirose, Kobe (JP); Shinji Tomita, Kobe (JP)

(73) Assignee: L'Air Liquide, Societe Anonyme Pour L'Etude Et L'Exploitation Des Procedes Geordes Claude, Paris (FR)

( * ) Notice: Subject to any disclaimer, the term of this patent is extended or adjusted under 35 U.S.C. 154(b) by 264 days.

(21) Appl. No.: 16/840,065

(22) Filed: Apr. 3, 2020

(65) Prior Publication Data

US 2020/0318898 A1 Oct. 8, 2020

(30) Foreign Application Priority Data

Apr. 8, 2019 (JP) ..... JP2019-73676

(51) Int. Cl.
*F25J 3/04* (2006.01)

(52) U.S. Cl.
CPC ..... *F25J 3/04284* (2013.01); *F25J 3/0443* (2013.01); *F25J 3/04321* (2013.01); *F25J 3/04412* (2013.01); *F25J 3/04709* (2013.01); *F25J 3/04872* (2013.01); *F25J 2200/32* (2013.01); *F25J 2200/50* (2013.01); *F25J 2215/50* (2013.01); *F25J 2215/56* (2013.01); *F25J 2245/02* (2013.01); *F25J 2245/58* (2013.01); *F25J 2250/20* (2013.01)

(58) Field of Classification Search
CPC .... F25J 3/04648; F25J 3/04654; F25J 3/0466; F25J 3/04666; F25J 3/04672; F25J 3/04678; F25J 3/04684; F25J 3/0469; F25J 3/04696; F25J 3/04703; F25J 3/04436; F25J 3/04442; F25J 3/04448; F25J 3/04454; F25J 3/048; F25J 3/4806; F25J 3/04721; F25J 3/04878; F25J 2245/00; F25J 2245/02; F25J 2245/40
See application file for complete search history.

(56) References Cited

U.S. PATENT DOCUMENTS

| | | | | |
|---|---|---|---|---|
| 1,571,461 | A * | 2/1926 | Van Nuys | F25J 3/04412 62/646 |
| 5,049,173 | A | 9/1991 | Cormier, Sr. et al. | |
| 5,934,104 | A | 8/1999 | Fidkowski et al. | |
| 2002/0108377 | A1* | 8/2002 | Guillard | F25J 3/04181 60/726 |
| 2009/0320520 | A1* | 12/2009 | Parsnick | F25J 3/04351 62/649 |
| 2014/0318179 | A1* | 10/2014 | Ha | F25J 3/04 62/643 |

* cited by examiner

*Primary Examiner* — Miguel A Diaz
*Assistant Examiner* — Erik Mendoza-Wilkenfel
(74) *Attorney, Agent, or Firm* — Justin K. Murray

(57) ABSTRACT

A cryogenic air separation apparatus comprises: a heat exchanger, a first rectification column, a first condenser, a second rectification column, a third rectification column, a second condenser, a high-purity oxygen rectification column, a third condenser, a nitrogen compressor, and a compressed recycled gas line L52 for introducing product nitrogen gas compressed by the first nitrogen compressor into a warm end (heat source) of an ultra-high-purity oxygen vaporizer as a compressed recycled gas.

5 Claims, 5 Drawing Sheets

CRYOGENIC AIR SEPARATION APPARATUS

CROSS REFERENCE TO RELATED APPLICATIONS

This application claims the benefit of priority under 35 U.S.C. § 119(a) and (b) to Japanese patent application No. JP 2019-73676, filed Apr. 8, 2019, the entire contents of which are incorporated herein by reference.

FIELD OF THE INVENTION

The present invention relates to a cryogenic air separation apparatus for producing nitrogen, argon and high-purity oxygen.

BACKGROUND OF THE INVENTION

There is a demand in the semiconductor industry, etc. for high-purity oxygen that does not contain high-boiling-point components such as hydrocarbons. In order to produce this high-purity oxygen, Patent Document 1 (U.S. Pat. No. 5,049,173), for example, describes a cryogenic air separation apparatus including three rectification columns, namely an intermediate-pressure column, a low-pressure column and a crude argon column, for producing nitrogen, oxygen and argon. Patent Document 1 describes a method in which an oxygen-rich liquid which is obtained from an intermediate portion of the crude-argon column and has had the high-boiling-point components removed therefrom is concentrated using intermediate-pressure nitrogen gas as a reboiling source. In addition to using intermediate-pressure nitrogen gas as a reboiling source, a method for obtaining high-purity oxygen using feed air or an oxygen-rich liquid obtained from a bottom portion of an intermediate-pressure column is also described, as disclosed in Patent Document 2 (U.S. Pat. No. 5,934,104), for example.

SUMMARY OF THE INVENTION

However, when intermediate-pressure nitrogen gas is used for reboiling high-purity oxygen, as in the prior art, there is a proportional reduction in the quantity of intermediate-pressure nitrogen gas supplied to the low-pressure column bottom portion. This leads to a reduction in the vapour stream in the low-pressure column and causes a marked reduction in the recovery of argon which is especially difficult to separate.

Argon constitutes merely 1% of the material weight ratio of the air component in relation to oxygen and nitrogen, so it is generally economical for cryogenic air separation apparatuses to be designed in such a way as to produce argon as a by-product of product oxygen or product nitrogen. However, if argon recovery is sacrificed in order to recover high-purity oxygen, as described above, it is likely to become necessary to design the cryogenic air separation apparatus commensurately with the amount of argon demand, and as a result there is a possibility of this leading to a situation which is economically inefficient.

There is a problem in the method which uses feed air as a reboiling source for high-purity oxygen in that there is a reduction in feed air supply to the intermediate-pressure column, and a reduction in the quantity of nitrogen recovered.

Furthermore, the method in which an oxygen-rich liquid supplied from an intermediate-pressure column bottom portion is used as a reboiling source makes it possible to recover only a small quantity of high-purity oxygen because it is possible only to use limited sensible heat corresponding to a temperature difference between the oxygen-rich liquid and the high-purity oxygen.

In light of the situation outlined above, the aim of certain embodiments of the present invention lie in providing a cryogenic air separation apparatus capable of recovering nitrogen, argon and high-purity oxygen at a high yield.

A cryogenic air separation apparatus according to at least one embodiment of the present invention can include:

- a heat exchanger (1) for subjecting feed air to heat exchange;
- a first rectification column (intermediate-pressure column) (2) to which feed air that has passed through the heat exchanger (1) is introduced, said first rectification column (intermediate-pressure column) (2) comprising a first column bottom portion (21) in which an oxygen-rich liquid is stored, a first rectification portion (22) for rectifying the feed air, and a first column top portion (23) which is disposed at an upper portion of the first rectification portion (22) and stores a first vaporized gas;
- a first condenser (nitrogen condenser) (3) which is disposed above the first column top portion (23) and condenses the first vaporized gas in the first column top portion (23);
- a second rectification column (5) comprising a second column bottom portion (31), a second rectification portion (51, 52, 53), and a second column top portion (54) from which nitrogen gas (which may become a product) is drawn;
- a third rectification column (crude argon column) (6) for rectifying argon, said third rectification column (6) comprising a third column bottom portion (61) to which is introduced a crude argon feed gas drawn from the intermediate portion (51) of the second rectification portion (50) of the second rectification column (5), a third rectification portion (62) for rectifying the crude argon feed gas, and a third column top portion (63) in which argon is stored;
- a second condenser (crude argon condenser) (7) which is disposed above the third column top portion (63) and condenses the argon in the third column top portion (63);
- a high-purity oxygen rectification column (8) for rectifying high-purity oxygen, said high-purity oxygen rectification column (8) comprising an oxygen column bottom portion (81) having a high-purity oxygen vaporizer (9) disposed in a lower region thereof, an oxygen rectification portion (82) to which is introduced an oxygen-rich liquid (intermediate-portion drawn liquid) drawn from an intermediate portion of the third rectification portion (62) of the third rectification column (6), and an oxygen column top portion (83) from which an oxygen vaporized gas is drawn to be returned to the intermediate portion of the third rectification portion (62) of the third rectification column (6);
- a third condenser (high-purity oxygen condenser) (4) which is disposed above the oxygen column top portion (83) and employs the oxygen vaporized gas in the oxygen column top portion (83) as a heat source;
- a first nitrogen compressor (10) for compressing a second nitrogen gas (which may become a product) drawn from an upper region (41) of the third condenser (4) and a first nitrogen gas (which may become a product) drawn from the second column top portion (54) of the second rectification column (5), after said second nitrogen gas and said first nitrogen gas have been made to pass through the heat exchanger (1); and a compressed recycled gas line (L52) for introducing product nitrogen gas compressed by the first nitrogen compressor (10) into a warm end (heat source) of the high-purity oxygen vaporizer (9) as a compressed recycled gas.

The abovementioned cryogenic air separation apparatus may also include:

an oxygen drawing line (L3) for extracting oxygen (which may become a product) which is drawn from the second column bottom portion (31) and passes through the heat exchanger (1);

an argon-gas drawing line (L63) for extracting (gas-state and/or liquid-state) argon (which may become a product) from the third column top portion (63);

an argon-containing liquid drawing line (L61) for introducing an argon-containing liquid drawn from the third column bottom portion (61) into a first intermediate stage (51) of the second rectification portion of the second rectification column (5);

a second-condenser vaporized-gas introduction line (L71) for introducing a second-condenser vaporized gas drawn from an upper region (71) of the second condenser (7) into a second intermediate stage (52) of the second rectification portion;

a high-purity liquid-oxygen drawing line (L81) for extracting high-purity liquid oxygen (which becomes a product) from the oxygen column bottom portion (81);

a first circulation line (L521) for introducing, into the upper region (41) of the third condenser (4), the compressed recycled gas which is drawn from the heat source of the high-purity oxygen vaporizer (9) and has been at least partially liquefied; and a second circulation line (L522) for introducing, into the second column top portion (54) of the second rectification column (low-pressure column) (5), the compressed recycled gas which is drawn from the heat source of the high-purity oxygen vaporizer (9) and has been at least partially liquefied.

The abovementioned cryogenic air separation apparatus may also include:

a first product-nitrogen gas line (L5) for introducing, into the heat exchanger (1), the first nitrogen gas drawn from the second column top portion (54) of the second rectification column (5); and a second product-nitrogen gas line (L84) for introducing, into the heat exchanger, the second nitrogen gas drawn from the upper region (41) of the third condenser (4).

The compressed nitrogen gas compressed by the first nitrogen compressor (10) may also be extracted via a product-nitrogen recovery line (L51).

The abovementioned cryogenic air separation apparatus may include a second nitrogen compressor (11) for compressing the second nitrogen gas which has passed through the heat exchanger (1) by means of the second product-nitrogen gas line (L84), and the compressed recycled gas obtained by compression in the second nitrogen compressor (11) may be introduced into the warm end (heat source) of the high-purity oxygen vaporizer (9) via the compressed recycled gas line (L52).

By virtue of the abovementioned configuration, an oxygen-rich liquid from which components having a higher boiling point than that of oxygen, such as hydrocarbons, have been removed is supplied to the high-purity oxygen rectification column (8) from the intermediate portion (rectification portion 62) of the third rectification column (crude argon column) (6), said oxygen-rich liquid is rectified, and ultra-high-purity oxygen (UPOX) is recovered from the bottom portion (81). Nitrogen gas (the first nitrogen gas and/or the second nitrogen gas) recovered from the warm end of the heat exchanger (1) is pressure-boosted by the first nitrogen compressor (10) or the second nitrogen compressor (11) and supplied as a reboiling source in the ultra-high-purity oxygen vaporizer (9) for rectifying ultra-high-purity oxygen.

Furthermore, at least a portion of the liquid nitrogen condensed by the ultra-high-purity oxygen vaporizer (9) is supplied to the second column top portion (54) of the second rectification column (low-pressure column) (5), whereby a reflux liquid in the second rectification column (low-pressure column) (5) can be increased, and it is possible to increase the quantity of first nitrogen gas recovered from the second column top portion (54).

Furthermore, at least a portion of the liquid nitrogen condensed by the ultra-high-purity oxygen vaporizer (9) is supplied as a cold source in the third condenser (high-purity oxygen condenser) (4) which is in the column top portion (83) of the high-purity oxygen rectification column (8), and the second nitrogen gas drawn from the upper region (41) of the third condenser (4) is supplied to the nitrogen compressor (10) via the heat exchanger (1), whereby rectification in the high-purity oxygen rectification column (8) and the third rectification column (crude argon column) (6) can be improved, and recovery of argon and ultra-high-purity oxygen is improved.

Furthermore, the second nitrogen gas can be drawn from the upper region of the third condenser at a higher pressure than the first nitrogen gas, so if the second nitrogen gas is supplied to the second nitrogen compressor (11) via the heat exchanger (1), compression can be performed at a lower compression ratio than in the first nitrogen compressor (10) and it is possible to save on the amount of power used for nitrogen compression in the rectification of high-purity oxygen.

In the abovementioned cryogenic air separation apparatus, the third rectification column (crude argon column) (6) may be divided into an upper crude argon column (620) and a lower crude argon column (610) at a point where the oxygen-rich liquid (intermediate-portion drawn liquid) introduced into the high-purity oxygen rectification column (8) is drawn.

The upper crude argon column (620) may comprise: a column lower portion (621), a column intermediate portion (622), and a column upper portion (623), and the lower crude argon column (610) may comprise: a column lower portion (611), a column intermediate portion (612), and a column upper portion (613).

The upper crude argon column (620) may be disposed in an upper portion of the high-purity oxygen rectification column (8), the high-purity oxygen condenser (4) may be disposed in an upper portion of the upper crude argon column (620), and the high-purity oxygen condenser (4) may condense the vaporized gas in the column upper portion (623) of the upper crude argon column (620).

By virtue of this configuration, the connection of the crude argon column (6) and the high-purity oxygen rectification column (8) may be simplified, and the construction of the rectification column may be further simplified.

The abovementioned cryogenic air separation apparatus may also comprise an expansion turbine (24) for expanding at least one gas out of: a mixed gas comprising two or more gases from among a feed air gas, nitrogen gas recovered from the second rectification column (low-pressure column)

(5), oxygen gas drawn from an upper portion (31) of the first condenser (3), and waste gas discharged from any of the first rectification column, second rectification column or third rectification column; and nitrogen gas pressure-boosted by the first nitrogen compressor (10) and/or the second nitrogen compressor (11).

By virtue of this configuration, expansion by the expansion turbine and the generation of cold makes it possible to maintain a cold balance in the apparatus while making use of process gas.

The abovementioned cryogenic air separation apparatus may also comprise a supply line (L9) for supplying liquid nitrogen to the first rectification column (intermediate-pressure column) (2) or to the second rectification column (low-pressure column) (5) as a cold source.

The supply line (L9) may also supply liquid nitrogen to the first column top portion (23) of the first rectification column (intermediate-pressure column) (2) or to the second column top portion (54) of the second rectification column (low-pressure column) (5).

By virtue of this configuration, when a large quantity of the product is to be recovered in a liquid, it is possible to maintain a cold balance in the cryogenic air separation apparatus even if the configuration is not provided with the expansion turbine 9, or even if there is a defect in the expansion turbine 9.

(Operational Advantage) According to the present invention, it is possible to recover nitrogen, argon and high-purity oxygen at a high yield.

BRIEF DESCRIPTION OF THE DRAWINGS

Further developments, advantages and possible applications of the invention can also be taken from the following description of the drawing and the exemplary embodiments. All features described and/or illustrated form the subject-matter of the invention per se or in any combination, independent of their inclusion in the claims or their back-references.

DETAILED DESCRIPTION OF THE INVENTION

Figure 1:
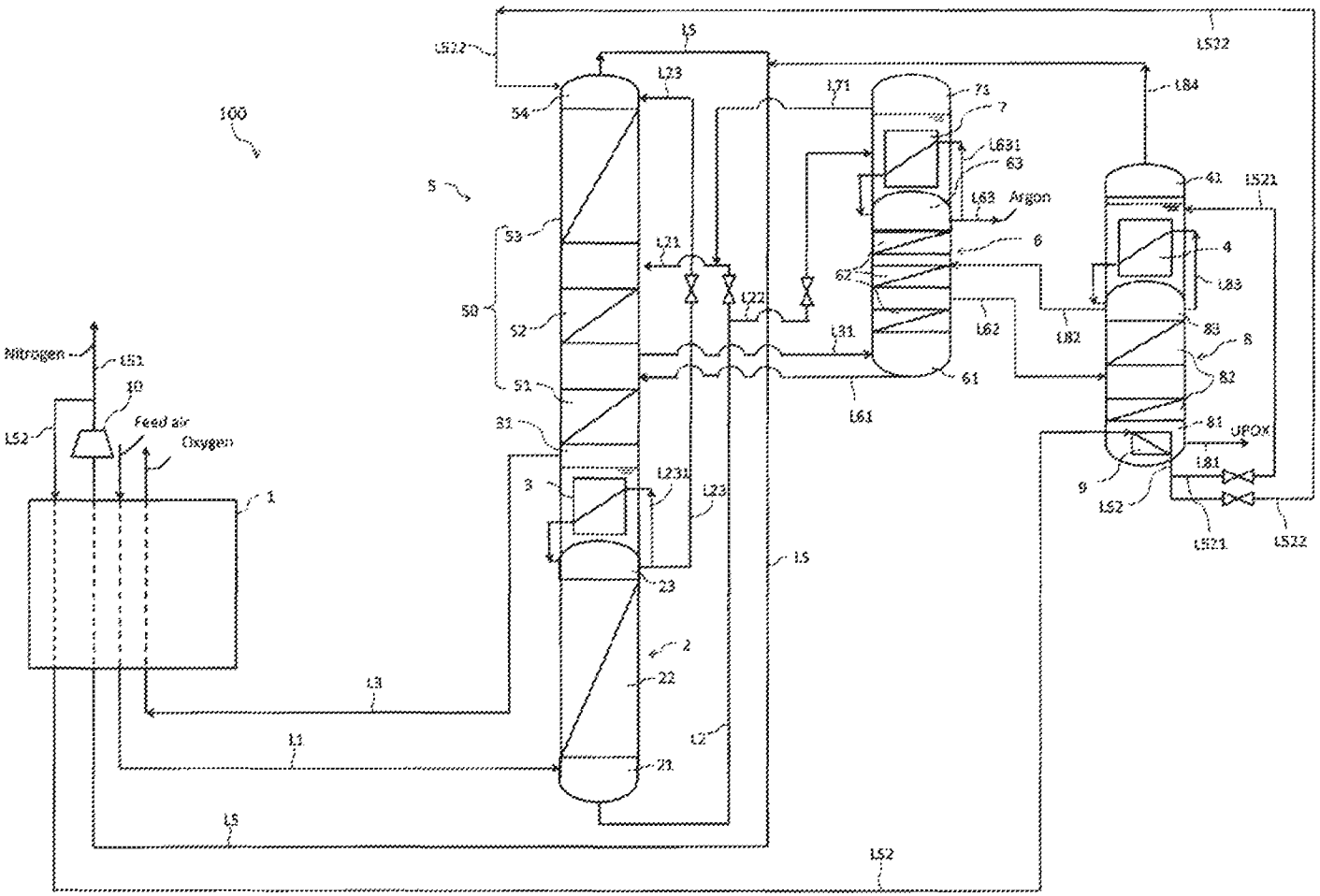
FIG. 1 shows a high-purity oxygen and nitrogen production system according to Mode of Embodiment 1.

Several modes of embodiment of the present invention will be described below. The modes of embodiment described below illustrate an example of the present invention. The present invention is in no way limited by the following modes of embodiment, and the present invention also includes various variant modes which are implemented within a scope that does not alter the essential point of the present invention. It should be noted that the constituent elements described below are not all necessarily essential to the present invention.

A cryogenic air separation apparatus according to Mode of Embodiment 1 will be described with the aid of FIG. 1.

A cryogenic air separation apparatus 100 has a basic configuration comprising, among other things: a heat exchanger 1, a first rectification column (intermediate-pressure column) 2, a second rectification column (low-pressure column) 5, a third rectification column (crude argon column) 6, and a high-purity oxygen rectification column 8.

Feed air passes through the heat exchanger 1 via a feed air introduction line L1 and is supplied to a first column bottom portion 21 (or a first rectification portion 22) of the first rectification column (intermediate-pressure column) 2.

The first rectification column 2 comprises: a first column bottom portion 21 in which an oxygen-rich liquid is stored; a first rectification portion 22 for rectifying the feed air; and a first column top portion 23 which is disposed at an upper portion of the first rectification portion 22 and stores a first vaporized gas.

A first condenser (nitrogen condenser) 3 is disposed above the first column top portion 23. The first condenser 3 condenses the first vaporized gas in the first column top portion 23.

The second rectification column 5 is disposed above the first condenser 3. The second rectification column 5 comprises: a second rectification portion 50 (51, 52, 53); and a second column top portion 54 from which nitrogen gas (which may become a product) is drawn.

The third rectification column 6 rectifies argon. The third rectification column 6 comprises: a third column bottom portion 61 to which is introduced a crude argon feed gas drawn from the intermediate portion 51 of the second rectification portion 50 (preferably a lower stage than a central position of the second rectification portion 50) of the second rectification column 5; a third rectification portion 62 for rectifying the crude argon feed gas; and a third column top portion 63 in which (gas-state and/or liquid-state) argon is stored.

A second condenser 7 is disposed above the third column top portion 63. The second condenser 7 condenses the (gas-state and/or liquid-state) argon in the third column top portion 63.

The high-purity oxygen rectification column 8 rectifies ultra-high-purity oxygen. The high-purity oxygen rectification column 8 comprises: an oxygen column bottom portion 81 having a high-purity oxygen vaporizer 9 disposed in a lower region thereof; an oxygen rectification portion 82 to which is introduced an oxygen-rich liquid (intermediate-portion drawn liquid) drawn from an intermediate portion of the third rectification portion 62 of the third rectification column 6; and an oxygen column top portion 83 from which an oxygen vaporized gas is drawn to be returned to the intermediate portion of the third rectification portion 62 of the third rectification column 6.

The third condenser 4 is disposed above the oxygen column top portion 83. The third condenser 4 utilizes the oxygen vaporized gas in the oxygen column top portion 83 as a heat source.

A first nitrogen compressor 10 compresses a second nitrogen gas drawn from an upper region 41 of the third condenser 4 and a first nitrogen gas drawn from the second column top portion 54 of the second rectification column 5, after said second nitrogen gas and said first nitrogen gas have been made to pass through the heat exchanger 1.

A first oxygen-rich-liquid introduction line (main line L2, first branch line L21) is a line for introducing, into the intermediate portion 52 of the second rectification portion 50 (preferably a higher stage than the central position of the second rectification portion 50), the oxygen-rich liquid drawn from the first column bottom portion 21 of the first rectification column 2.

A second oxygen-rich-liquid introduction line (main line L2, second branch line L22) is a line for introducing, into the second condenser 7, the oxygen-rich liquid drawn from the first column bottom portion 21 of the first rectification column 2.

A first vaporized-gas introduction line L23 is a line for introducing, into the second column top portion 54 of the second rectification column 5, the first vaporized gas drawn from the first column top portion 23 of the first rectification column 2.

A portion of the first vaporized gas is introduced as a heat source in the first condenser 3 via a branch line L231 branching from the first vaporized gas introduction line L23, the heat is released from said portion of the first vaporized gas to cool said first vaporized gas, and it is then returned to the first column top portion 23.

An oxygen drawing line L3 is a line for allowing (gas-state and/or liquid-state) oxygen drawn from the second column bottom portion 31 of the second rectification column 5 to pass through the heat exchanger 1, and for extracting oxygen (as a product or as a waste gas).

An intermediate-portion drawing line L31 is a line for introducing, into the third column bottom portion 61 of the third rectification column 6, the crude argon feed gas drawn from the intermediate portion 52 of the second rectification portion 50 (preferably a lower stage than the central position of the second rectification portion 50).

A first product-nitrogen gas line L5 is a line for introducing, into the heat exchanger 1, the first nitrogen gas drawn from the second column top portion 54 of the second rectification column 5. Compressed nitrogen gas compressed by the first nitrogen compressor 10 is extracted via a product-nitrogen recovery line L51.

A compressed recycled gas line L52 introduces product nitrogen gas compressed by the first compressor 10 into a warm end (heat source) of the ultra-high-purity oxygen vaporizer 9 as compressed recycled gas.

A first circulation line L521 is a line which branches from the compressed recycled gas line L52 and introduces, into the upper region 41 of the third condenser 4, the compressed recycled gas drawn from the heat source in the ultra-high-purity oxygen vaporizer 9.

A second circulation line L522 is a line which branches from the compressed recycled gas line L52 and introduces, into the second column top portion 54 of the second rectification column 5, the compressed recycled gas drawn from the heat source in the ultra-high-purity oxygen vaporizer 9.

An argon-containing-liquid drawing line L61 is a line for introducing, into the intermediate portion 51 of the second rectification portion 50 (preferably a lower stage than the central position of the second rectification portion 50) of the second rectification column 5, an argon-containing liquid drawn from the third column bottom portion 61.

An intermediate portion drawing line L62 is a line for introducing, into an intermediate portion of the oxygen rectification portion 82 (preferably a lower stage than a central position of the oxygen rectification portion 82), an oxygen-rich liquid (intermediate-portion drawn liquid) drawn from the intermediate portion of the third rectification portion 62 (preferably a lower stage than a central position of the third rectification portion 62).

An argon-gas drawing line L63 is a line for extracting (gas-state and/or liquid-state) argon from the third column top portion 63.

The (gas-state and/or liquid-state) argon passes through a branch circulation line L631 branching from the argon-gas drawing line L63, is introduced as a heat source in the second condenser 7, heat is released therefrom and said argon gas is cooled and liquefied, then returned to the third column top portion 63.

A second-condenser vaporized-gas introduction line L71 is a line for introducing, into the intermediate portion 52 of the second rectification portion 50 (preferably a stage higher than the central position of the second rectification portion 50), a second-condenser vaporized gas drawn from an upper region 71 of the second condenser 7.

A high-purity liquid-oxygen drawing line L81 is a line for extracting high-purity liquid oxygen from the oxygen column bottom portion 81.

An oxygen vaporized-gas drawing line L82 is a line for feeding oxygen vaporized gas drawn from the oxygen column top portion 83 to a higher stage than a drawing position of the intermediate-portion drawing line L62 of the rectification portion 62 of the third rectification column 6.

The oxygen vaporized gas drawn from the oxygen column top portion 83 is introduced as a heat source in the third condenser 4 via a circulation line L83, the heat is released therefrom and said oxygen vaporized gas is cooled and liquefied, then returned to the oxygen column top portion 83.

A second product-nitrogen gas line L84 is a line for introducing, into the heat exchanger 1, the second nitrogen gas drawn from the upper region 41 of the third condenser 4.

As shown in FIG. 1, the second product-nitrogen gas line L84 merges with the first product-nitrogen gas line L5 before reaching the heat exchanger 1. The first product-nitrogen gas line L5 reaches the heat exchanger 1, and the merged first nitrogen gas and second nitrogen gas are compressed by the first nitrogen compressor 10. It should be noted that, as a different mode of embodiment, it is equally possible for the second product-nitrogen gas line L84 to merge with the first product-nitrogen gas line L5 after having passed through the heat exchanger 1, and for the merged first nitrogen gas and second nitrogen gas to be compressed by the first nitrogen compressor 10.

Figure 2:
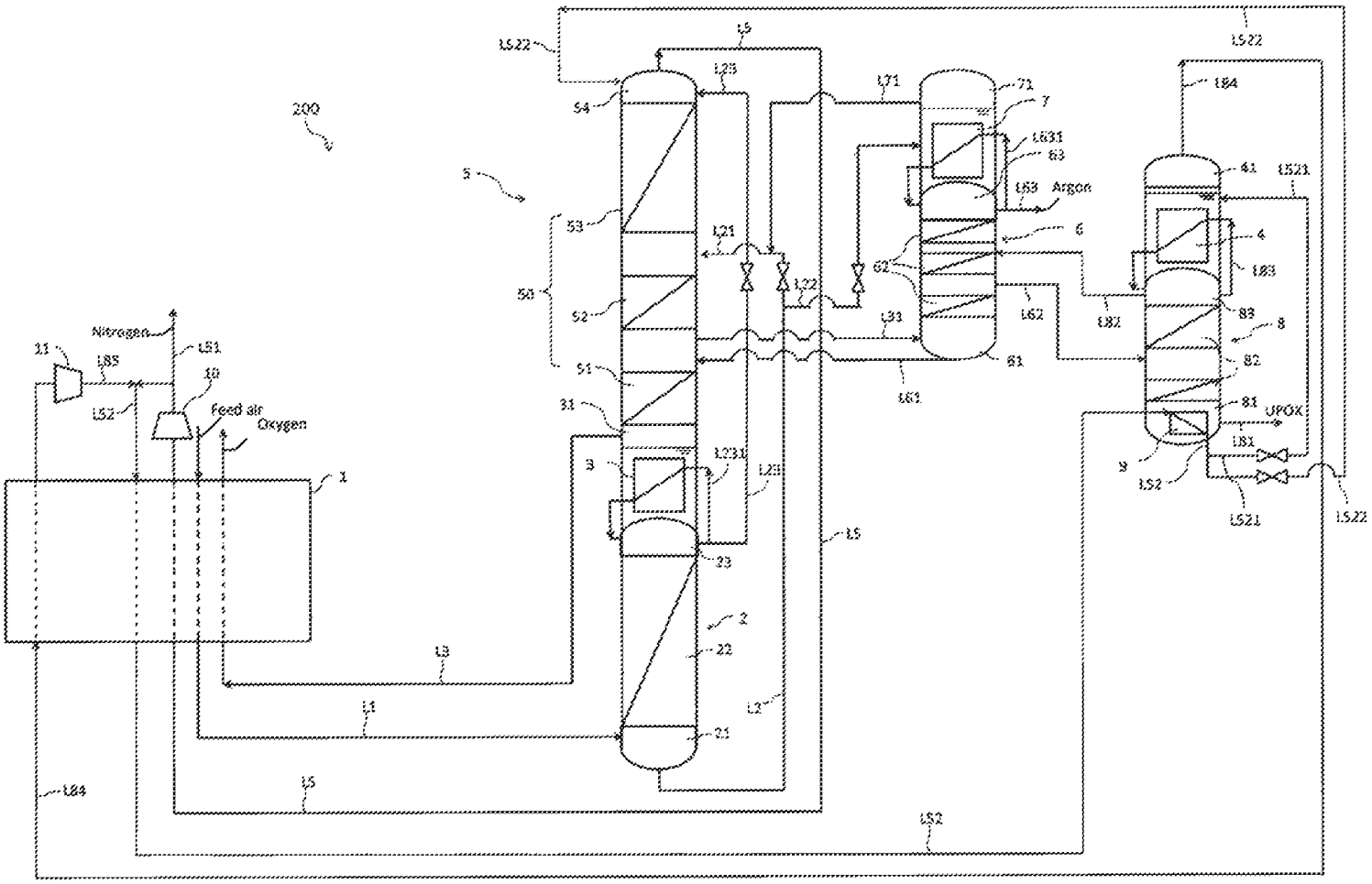
FIG. 2 shows a variant example of Mode of Embodiment 1.

FIG. 2 shows a variant example of Mode of Embodiment 1.

In a cryogenic air separation apparatus 200, the second product-nitrogen gas line L84 reaches a second nitrogen compressor 11 via the heat exchanger 1, without merging with the first product-nitrogen gas line L5.

The second nitrogen compressor 11 compresses the second nitrogen gas (recycled nitrogen gas). The recycled nitrogen gas which has been compressed merges with a portion of the product nitrogen gas compressed by the first nitrogen compressor 10 and is introduced into the heat source in the ultra-high-purity oxygen vaporizer 9 via the compressed recycled gas line L52. It should be noted that the product nitrogen gas compressed by the first nitrogen compressor 10 may equally be recovered as product nitrogen without further treatment and without being fed to the compressed recycled gas line L52, in other words, only the second nitrogen gas may be a recycled nitrogen gas supply source.

A cryogenic air separation apparatus according to Mode of Embodiment 2 will be described with the aid of FIG. 3. The description will be given in regard to constituent elements which are different from those of FIG. 1 relating to Mode of Embodiment 1, and a description will be omitted or simplified for constituent elements which are the same.

In a cryogenic air separation apparatus 300, the third rectification column 6 is divided into an upper crude argon column 620 and a lower crude argon column 610 at a point where the oxygen-rich liquid (intermediate-portion drawn liquid) introduced into the high-purity oxygen rectification column 8 is drawn.

The upper crude argon column 620 comprises: a column lower portion 621, a column intermediate portion 622, and a column upper portion 623.

The lower crude argon column 610 comprises: a column lower portion 611, a column intermediate portion 612, and a column upper portion 613.

The upper crude argon column 620 is disposed in an upper portion of the high-purity oxygen rectification column 8.

The high-purity oxygen condenser 4 is disposed in an upper portion of the upper crude argon column 620. The high-purity oxygen condenser 4 condenses the vaporized gas in the column upper portion 623 of the upper crude argon column 620.

The (gas-state and/or liquid-state) argon is drawn from the column upper portion 623 via the argon-gas drawing line L63. Furthermore, a portion of the (gas-state and/or liquid-state) argon passes through the first branch line L631 branching from the argon-gas drawing line L63, is introduced as a heat source in the second condenser 7, heat is released therefrom and said argon gas is cooled and liquefied, then returned to the column upper portion 623. Furthermore, a portion of the (gas-state and/or liquid-state) argon passes through a second branch line L632 branching from the argon-gas drawing line L63, is introduced as a heat source in the high-purity oxygen condenser 4, heat is released therefrom and said argon gas is cooled and liquefied, then returned to the column upper portion 623.

There is no particular limitation as to the location where the second condenser 7 is installed, but it is preferably installed close to the first rectification column 2, the second rectification column 5, and the upper crude argon column 620.

The high-purity oxygen condenser 4 is disposed in an upper portion of the upper crude argon column 620, but it is equally possible for the second condenser 7 to be disposed in an upper portion of the upper crude argon column 620. The second condenser 7 may equally be disposed in an upper portion of the high-purity oxygen condenser 4, or the opposite arrangement may be employed.

In Mode of Embodiment 2 and other modes of embodiment, "upper" and "lower" are concepts which are not limited to a vertical direction, and also include an oblique direction.

A cryogenic air separation apparatus according to Mode of Embodiment 3 will be described with the aid of FIG. 4. The description will be given in regard to constituent elements which are different from those of Mode of Embodiment 2 (FIG. 3), and a description will be omitted or simplified for constituent elements which are the same.

A cryogenic air separation apparatus 400 comprises an expansion turbine 24 for expanding at least one gas out of: a mixed gas comprising two or more gases from among a feed air gas, nitrogen gas recovered from the second rectification column 5, oxygen gas drawn from the upper portion 31 of the first condenser 3, and waste gas discharged from any of the first rectification column, second rectification column or third rectification column; and nitrogen gas pressure-boosted by the first nitrogen compressor 10.

Figure 3:
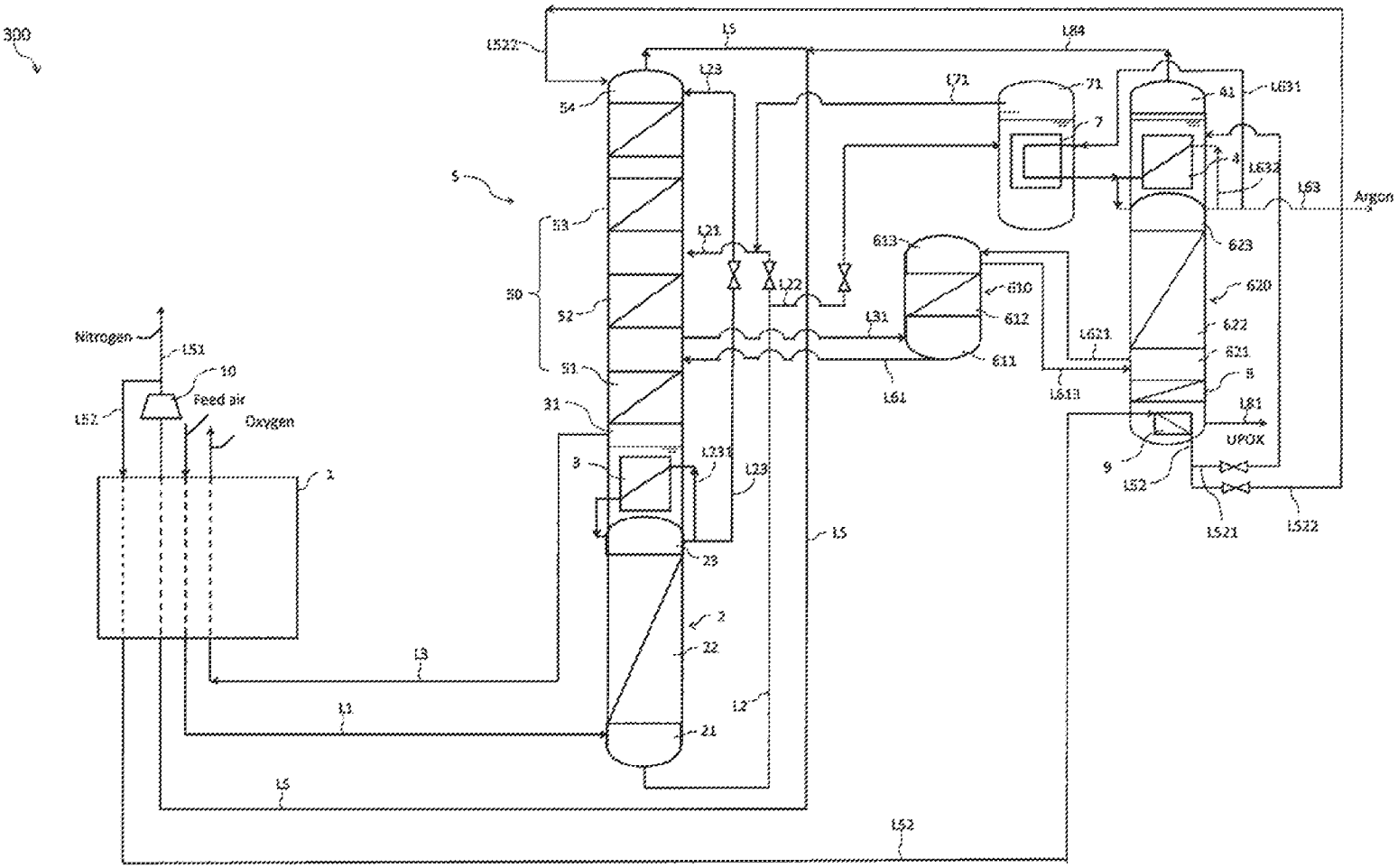
FIG. 3 shows a high-purity oxygen and nitrogen production system according to Mode of Embodiment 2.
Figure 4:
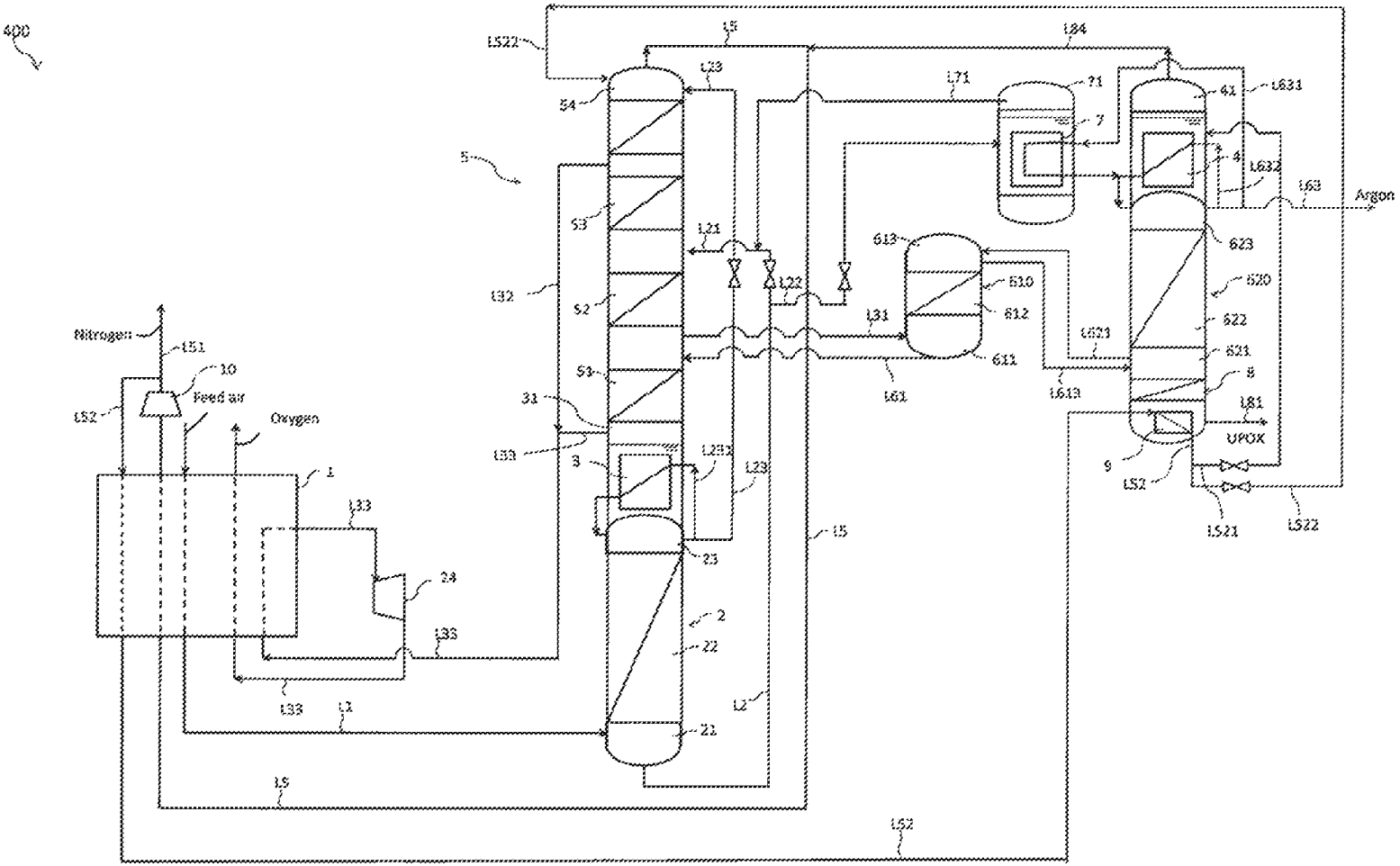
FIG. 4 shows a high-purity oxygen and nitrogen production system according to Mode of Embodiment 3.

In the example of FIG. 3, the (gas-state and/or liquid-state) oxygen drawn from the second column bottom portion 31 of the second rectification column 5 passes through the heat exchanger 1 via a first discharge line L33, exits an intermediate portion of the heat exchanger 1 and is fed to the expansion turbine 24. The oxygen gas is expanded by the expansion turbine 24, passes through the heat exchanger 1, and is recovered as waste gas (oxygen gas).

It should be noted that in FIG. 3, a second discharge line L32 merges with the first discharge line L33, but the arrangement of lines is not limited to this.

A cryogenic air separation apparatus according to Mode of Embodiment 4 will be described with the aid of FIG. 5. The description will be given in regard to constituent elements which are different from those of Mode of Embodiment 3 (FIG. 4), and a description will be omitted or simplified for constituent elements which are the same.

A cryogenic air separation apparatus 500 comprises a supply line L9 for supplying liquid nitrogen to the first rectification column 2 or to the second rectification column 5 as a cold source.

Figure 5:
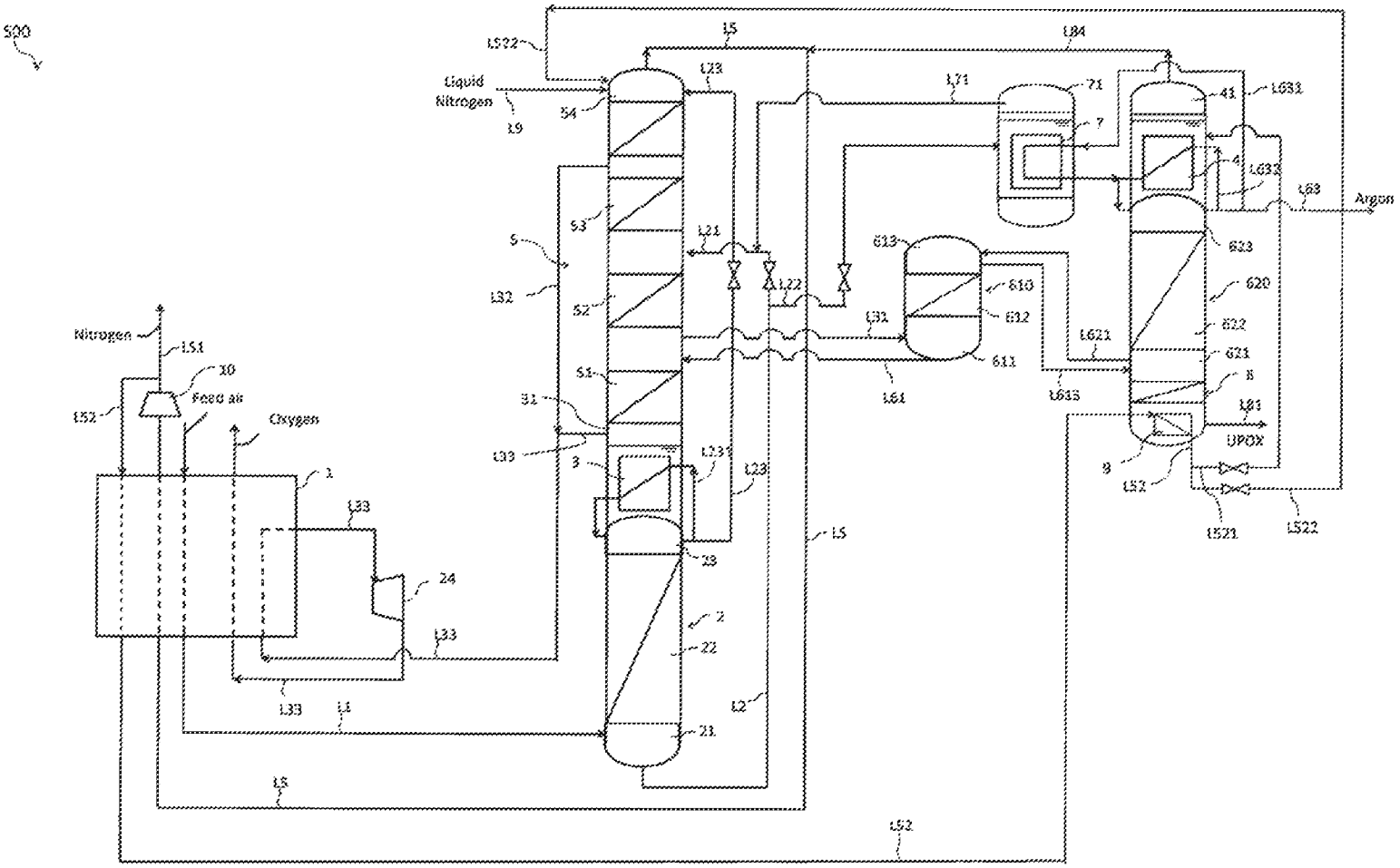
FIG. 5 shows a high-purity oxygen and nitrogen production system according to Mode of Embodiment 4.

In FIG. 5, the supply line L9 supplies liquid nitrogen to the second column top portion 54 of the second rectification column 5.

The cryogenic air separation apparatus 100 according to Mode of Embodiment 1 (FIG. 1) will be described in more specific terms.

Feed air is supplied from the warm end of the heat exchanger 1 at 5.8 barA, 20° C. and 1014 $Nm^3/h$. The feed air is cooled to −172° C. and then supplied to the first column bottom portion 21 of the first rectification column 2. The operating pressure of the intermediate-pressure column 2 is 5.7 barA and the number of theoretical stages is 50.

The feed air is rectified by the first rectification column 2, nitrogen is concentrated in the first column top portion 23, and oxygen-rich liquid is recovered from the first column bottom portion 21.

The nitrogen is supplied from the first column top portion 23 to the nitrogen condenser 3, condensed into liquid nitrogen, and fed back to the first column top portion 23.

A portion of the condensed liquid nitrogen is supplied to the second column top portion 54 of the second rectification column 5.

At least a portion of the oxygen-rich liquid drawn from the first column bottom portion 21 is supplied as a cold source to the crude argon condenser 7, and the remaining oxygen-rich liquid is supplied to the intermediate portion 52 of the second rectification column 5.

The second rectification column 5 is operated at 1.45 barA and the number of theoretical stages is 80. Nitrogen gas is recovered from the second column top portion 54 and supplied to a cold end of the heat exchanger 1 where the cold is released therefrom, after which it is recovered from the warm end.

Oxygen is recovered from the second column bottom portion 31 of the second rectification column 5. The oxygen may be recovered in a liquid state, or it may be drawn in a gas state with the cold being released therefrom via the heat exchanger 1, and then recovered as oxygen gas.

The nitrogen condenser 3 is disposed in a bottom portion of the second rectification column 5, and liquid oxygen is vaporized by means of heat exchange with intermediate-pressure nitrogen, whereby a vapour stream is supplied to the second rectification column 5.

A crude argon feed gas is drawn from the intermediate portion 50 of the second rectification column 5 and is supplied to the third column bottom portion 61 and rectified. The third rectification column 6 is operated at 1.4 barA and the number of theoretical stages is 160. The crude argon condenser 7 is disposed at an upper portion of the column. A crude argon liquid is recovered at 8.3 $Nm^3/h$ from the third column top portion 63.

A high-purity oxygen feed liquid is drawn from the intermediate portion 62 of the crude argon column 6 and is supplied to the intermediate portion or the column top portion of the high-purity oxygen rectification column 8 and rectified, then ultra-high-purity liquid oxygen is recovered at 7.3 $Nm^3/h$. The operating pressure of the high-purity oxygen rectification column 8 is 1.4 barA and the number of theoretical stages is 80.

The ultra-high-purity oxygen vaporizer 9 is disposed in the column bottom portion 81 of the high-purity oxygen rectification column 8, and is configured to supply a vapour stream to the high-purity oxygen rectification column 8. The high-purity oxygen condenser 4 is disposed in the column top portion 83 of the high-purity oxygen rectification column 8, and is configured to supply a reflux liquid to the high-purity oxygen rectification column 8.

Nitrogen which has been pressure-boosted to 5.8 barA by means of the first nitrogen compressor 10 is supplied from the warm end of the heat exchanger 1 at 247 $Nm^3/h$ and cooled to −176° C., after which it is supplied as a reboiling source to the ultra-high-purity oxygen vaporizer 9.

At least a portion of the condensed liquid nitrogen is supplied as a cold source to the ultra-high-purity oxygen condenser 9, and after being vaporized, it is supplied to the cold end of the heat exchanger 1 and the cold is released therefrom, after which it is recovered from the warm end. The recovered nitrogen may also once again be pressure-boosted by the nitrogen compressor.

The abovementioned configuration makes it possible to supply the heat source required for obtaining ultra-high-purity oxygen without increasing the quantity of feed air. As described above, when ultra-high-purity oxygen is recovered at 7.3 $Nm^3/h$ from feed air at 1014 $Nm^3/h$, argon recovery is limited to 4.2 $Nm^3/h$ with the conventional technology, but the above configuration makes it possible to recover argon at 8.3 $Nm^3/h$, which is approximately twice the above recovery, so there can be a considerable improvement of the economic aspect of the apparatus.

Results

The superiority of Exemplary Embodiments 1-3 corresponding to Modes of Embodiment 1-3 will be described by comparison with Comparative Example 1.

Comparative Example 1: Patent Document 1 (U.S. Pat. No. 5,049,173 A)

Exemplary Embodiment 1: FIG. 1 in Mode of Embodiment 1

Exemplary Embodiment 2: FIG. 2 in the Variant Example of Mode of Embodiment 1

Exemplary Embodiment 3: FIG. 3 in Mode of Embodiment 3

Exemplary Embodiment 1 and Comparative Example 1 will be compared. In Exemplary Embodiment 1, in order to produce ultra-high-purity oxygen, nitrogen for reboiling and condensing in the high-purity oxygen rectification column 8 is supplied by means of the nitrogen compressor 10, rather than a cryogenic air separation process fluid, such as intermediate-pressure nitrogen gas which is indispensable for maintaining the recovery rate of product argon, being introduced as a heat source, as in the comparative example, and it is therefore possible to produce ultra-high-purity oxygen while the product argon recovery rate is maintained at a high level. As described above, approximately twice the quantity of high-purity oxygen can be recovered in comparison with the prior art.

Exemplary Embodiment 2 and Exemplary Embodiment 1 will be compared.

In Exemplary Embodiment 1, nitrogen gas drawn from the high-purity oxygen condenser 4 and nitrogen gas recovered from the column top portion 54 of the second rectification column are both introduced into the first nitrogen compressor 10. However, the nitrogen operating pressure in the ultra-high-purity oxygen vaporizer 9 does not necessarily have to be the discharge pressure of the first nitrogen compressor 10, in other words the product nitrogen gas pressure. The nitrogen operating pressure in the high-purity oxygen condenser 4 does not necessarily have to be equivalent to the intake pressure of the first nitrogen compressor 10. Rather, the optimum nitrogen pressure ratio for vaporization or condensing of ultra-high-purity oxygen may be smaller than the compression ratio of the first nitrogen compressor 10, so it is possible to save on the amount of energy consumed by employing the second nitrogen compressor 11 at an optimum compression ratio for the purpose of ultra-high-purity oxygen rectification. Since the quantity of nitrogen required by the high-purity oxygen condenser 4 is smaller than that of the ultra-high-purity oxygen vaporizer 9, a portion of the nitrogen condensed by the ultra-high-purity oxygen vaporizer 9 is reduced in pressure and introduced as a reflux liquid into the column top portion 54 of the second rectification column 5, recovered as nitrogen gas, compressed by the first nitrogen compressor 10, and merged in a discharge line of the second nitrogen compressor 11, thereby making it possible to maintain a nitrogen cycle balance for efficient high-purity oxygen rectification.

In one example which can be envisaged, the low-pressure nitrogen pressure is 1.1 barA, and the pressure of product nitrogen which has been pressure-boosted by the nitrogen compressor 10 is 5.6 barA. The operating pressure of the high-purity oxygen rectification column 8 is substantially the same pressure as that of the second rectification column 5, and when this is 1.2 barA, the optimum nitrogen pressure in the ultra-high-purity oxygen vaporizer 9 is 5.6 barA, and the high-purity oxygen condenser 4 is at 2.7 barA. The compression ratio when nitrogen for rectification of this ultra-high-purity oxygen is compressed by the recycling compressor 11 is 5.6/2.7=2.1 times, but the ratio in terms of compression at the nitrogen compression ratio is 5.6/1.1=5.1, so a saving of approximately 55% in the compression power can be achieved when the recycling nitrogen compressor 11 is used.

Exemplary Embodiment 3 and Exemplary Embodiment 1 will be compared.

The crude argon column 6 and the high-purity oxygen rectification column 8 have sections with an overlapping function for separating argon and oxygen, so it is possible for argon and oxygen separation to be performed by the same rectification column. The boiling points of argon and oxygen are very close, and the number of theoretical stages required for separation increases, so the crude argon column 6 and the high-purity oxygen rectification column 8 tend to be very high, and therefore it is possible to make cost savings by using the same rectification column combining the upper crude argon column 620 and the high-purity oxygen rectification column 8, these cost savings being afforded by a material saving effect due to the reduction in the number of high columns.

In Exemplary Embodiment 3, the argon-containing gas supplied to the crude argon column bottom portion includes high-boiling-point components such as hydrocarbons, and therefore a gas from which those components have been removed by the lower crude argon column 610 is supplied to the upper crude argon column 620.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

LIST OF REFERENCE NUMERALS

1 . . . Heat exchanger
2 . . . First rectification column
3 . . . First condenser
4 . . . Third condenser
5 . . . Second rectification column
6 . . . Third rectification column
7 . . . Second condenser
8 . . . High-purity oxygen condenser
9 . . . Ultra-high-purity oxygen vaporizer
10 . . . First nitrogen compressor
11 . . . Second nitrogen compressor

What is claimed is:

1. A cryogenic air separation apparatus comprising:

a heat exchanger configured to subject feed air to heat exchange;

a first rectification column in fluid communication with the heat exchanger such that the first rectification column is configured to receive the feed air from the heat exchanger, said first rectification column comprising a first column bottom portion in which an oxygen-rich liquid is stored, a first rectification portion for rectifying the feed air, and a first column top portion which is disposed at an upper portion of the first rectification portion and stores a first vaporized gas;

a first condenser disposed above the first column top portion, the first condenser being configured to use the first vaporized gas in the first column top portion as a heat source;

a second rectification column comprising a second column bottom portion, an intermediate portion comprising a second rectification portion, and a second column top portion from which a first nitrogen gas is drawn;

a third rectification column configured to rectify argon that is in fluid communication with the intermediate portion of the second rectification column, said third rectification column comprising a third column bottom portion that is configured to receive a crude argon feed gas from the intermediate portion of the second rectification portion of the second rectification column, a third rectification portion configured to rectify the crude argon feed gas, and a third column top portion configured to store argon;

a second condenser disposed above the third column top portion and configured to use the argon in the third column top portion as a heat source;

a high-purity oxygen rectification column configured to rectify ultra-high-purity oxygen, said high-purity oxygen rectification column comprising: a high-purity oxygen column bottom portion having an ultra-high-purity oxygen vaporizer disposed in a lower region of the high-purity oxygen rectification column, an oxygen rectification portion that is configured to receive an oxygen-rich liquid drawn from an intermediate portion of the third rectification portion of the third rectification column, and a high-purity oxygen column top portion that is in fluid communication with the intermediate portion of the third rectification column, such that an oxygen vaporized gas can be sent from the high-purity oxygen column top portion to the intermediate portion of the third rectification portion of the third rectification column;

a third condenser disposed above the high-purity oxygen column top portion and configured to use the oxygen vaporized gas in the high-purity oxygen column top portion as a heat source;

a first nitrogen compressor configured to compress a second nitrogen gas drawn from an upper region of the third condenser and the first nitrogen gas drawn from the second column top portion of the second rectification column, after said second nitrogen gas and said first nitrogen gas have been made to pass through the heat exchanger; and a compressed recycled gas line configured to introduce product nitrogen gas compressed by the first nitrogen compressor into a warm end of the ultra-high-purity oxygen vaporizer as a compressed recycled gas.

2. The cryogenic air separation apparatus according to claim 1, further comprising a second nitrogen compressor for compressing the second nitrogen gas which is drawn from the upper region of the third condenser and has passed through the heat exchanger.

3. The cryogenic air separation apparatus according to claim 1, wherein the third rectification column is divided into an upper crude argon column and a lower crude argon column at a point where the oxygen-rich liquid introduced into the ultra-high-purity oxygen rectification column is drawn.

4. The cryogenic air separation apparatus according to claim 1, further comprising an expansion turbine for expanding at least one gas out of: a mixed gas comprising two or more gases from among a feed air gas, nitrogen gas recovered from the second rectification column, oxygen gas drawn from an upper portion of the first condenser, and waste gas discharged from any of the first rectification column, second rectification column or third rectification column; and nitrogen gas pressure-boosted by the first nitrogen compressor and/or the second nitrogen compressor.

5. The cryogenic air separation apparatus according to claim 1, further comprising a supply line for supplying liquid nitrogen to the first rectification column or to the second rectification column as a cold source.

* * * * *